US005953199A

United States Patent [19]

Owens

[11] Patent Number: 5,953,199

[45] Date of Patent: Sep. 14, 1999

[54] COMPUTER TOUCH PAD COVER AND METHOD

[76] Inventor: Steve Owens, 619 E. Brevard St., Tallahassee, Fla. 32308

[21] Appl. No.: 08/949,345

[22] Filed: Oct. 14, 1997

[51] Int. Cl.[6] ..... H05F 3/00

[52] U.S. Cl. ..... 361/212; 361/220

[58] Field of Search ..... 345/173; 361/212, 361/220, 683

[56] References Cited

U.S. PATENT DOCUMENTS

| | | | |
|---|---|---|---|
| 4,441,001 | 4/1984 | Miyano et al. . | |
| 4,468,702 | 8/1984 | Jandrell | 361/220 |
| 4,586,106 | 4/1986 | Frazier | 361/212 |
| 4,654,746 | 3/1987 | Lewis, Jr. et al. | 361/212 |
| 4,745,518 | 5/1988 | Fang | 361/220 |
| 4,865,483 | 9/1989 | Snook | 361/212 |
| 5,067,573 | 11/1991 | Uchida | 345/173 |
| 5,252,952 | 10/1993 | Frank et al. . | |
| 5,448,405 | 9/1995 | Clausen et al. | 361/220 |
| 5,457,289 | 10/1995 | Huang et al. . | |
| 5,469,194 | 11/1995 | Clark et al. . | |
| 5,486,847 | 1/1996 | Ranf et al. . | |
| 5,543,588 | 8/1996 | Bisset et al. . | |
| 5,552,957 | 9/1996 | Brown et al. | 361/683 |
| 5,579,036 | 11/1996 | Yates, IV . | |
| 5,588,760 | 12/1996 | So . | |
| 5,668,612 | 9/1997 | Hung | 361/220 |
| 5,747,748 | 5/1998 | Zigler | 345/173 |

OTHER PUBLICATIONS

Trackpad Climate Control, Version 1.1, Oct. 23, 1996 (Apple Computer Company) pp. 1–2.

*Primary Examiner*—Fritz Fleming
*Attorney, Agent, or Firm*—Hardaway Law Firm, PA

[57] ABSTRACT

The present invention offers a touch pad cover for the touch pad of a Laptop/Notebook computer whereby the touch pad is protected from environmental conditions such as static electricity, particularly the static charge of a computer monitor when the computer is in a closed position and from the static charge transferred by the user, thus reducing the likelihood of a malfunctioning computer touch pad. These, as well as other objects of the invention, are accomplished by a cover for a touch pad of a Laptop/Notebook computer, the computer having a touch pad and an upper portion; the cover comprising an upper surface of nonconductive material (e.g. neoprene) in contact with the upper portion of the computer when the computer is in a closed position; a lower surface of nonconductive material opposite and parallel the upper surface, the lower surface in contact with the touch pad of the computer and depositing a powder residue of nonconductive material on the touch pad. The touch pad cover further comprises a storage compartment for storage of the touch pad cover when the computer is not in use.

18 Claims, 2 Drawing Sheets

COMPUTER TOUCH PAD COVER AND METHOD

FIELD OF THE INVENTION

This invention relates generally to the art of protecting Laptop/Notebook computer touch pads from environmental conditions such as static electricity and more particularly to a cover for the touch pad of a Laptop/Notebook computer which is designed to shield the touch pad from static charges generally transferred from the computer monitor when the computer is in a closed position or from the computer's user, thus reducing the likelihood of a malfunctioning computer touch pad.

1. Background of the Invention

Computer touch pads are now in common use in Laptop/Notebook computers throughout the world. Touch pads sense the inherent capacitance associated with a user's finger. Thereby, a cursor can be controlled according to the movement of a user's finger. The computer mimics this movement and drags the cursor across the screen to any desired location. Several embodiments related to computer touch pads are described in U.S. Pat. No. 5,469,194, incorporated herein by reference.

Due to environmental conditions, possibly static electricity, the touch pad malfunctions from time to time. As a result, the cursor will jump around erratically and the computer will become unusable. This very problem has been noted by MCINTOSH computer company which developed a TRACKPAD CLIMATE CONTROL system, a system extension used to reduce or eliminate unexpected movements of the cursor caused by moisture on the touch pad or by humidity. This system is operable only with the POWERBOOK 190, POWERBOOK 1400 AND POWERBOOK DUO 2300 computer systems THE TRACKPAD CLIMATE CONTROL system, however, is not recommended for use if there are no cursor-movement problems because the system could make the cursor less responsive when the touch pad is used.

The present invention, on the other hand, is intended to address the problem of erratic cursor movement due to static or other environmental conditions without effecting the responsiveness of the touch pad and without limitation to a specific type of operating system.

2. Prior Art

U.S. Pat. No. 5,579,036, issued to Yates, IV on Nov. 26, 1996, discloses a bracket for shielding a capacitive touch screen from external noise arising from stray capacitance. Specifically, Yates discloses a shield element of rigid conductive material with a large central aperture such that the touch screen is accessible to the user. The shielding bracket provides a full shield for the upper, lower and edge surfaces of the touch screen to prevent the capacitance of a hand resting on the housing from interfering with the touch screen. This configuration, however, does not address the concerns related to the touch pad.

U.S. Pat. No. 5,457,289, issued to Huang et al. on Oct. 10, 1995, discloses a frontally shielded capacitive touch sensor system. Specifically, Huang discloses a front shield mounted in front of a touch sensor and extending peripherally about a touch sensitive surface. This invention uses a supplied voltage on the shield for controlling the capacitance between the touch sensor and the front shield, shielding the system from stray capacitance occurring at the front shield. This configuration is not directed towards the problems related to a malfunctioning touch pad.

U.S. Pat. No. 5,486,847, issued to Ranf et al. on Jan. 23, 1996, discloses an apparatus for a pen-based input system (e.g., notepad computer) which shields against RFI/EMI fields causing problems either in the internal electronics or in the environment surrounding the system. A special transparent conductive layer (e.g., Indium-Tin-Oxide) is placed beneath the pen input protective plate to shield the internal electronics from external RFI/EMI sources, such as cellular phone systems, and to reduce the RFI/EMI released to the environment. This invention, again, is not directed towards the problems associated with the touch pad.

Accordingly, much room for improvement exists within the art to extend or prolong the life of the computer touch pad.

SUMMARY OF THE INVENTION

It is, thus, an object of this invention to provide a novel touch pad cover which reduces computer problems related to a malfunctioning touch pad.

It is a further object of this invention to provide a novel touch pad cover which can be placed over the touch pad to provide shielding from the upper portion of the computer when the computer is in a closed position.

It is also the object of this invention to provide a novel touch pad cover which can protect the touch pad from environmental concerns, such as static electricity.

These, as well as other objects, are accomplished by providing a cover for a touch pad of a Laptop/Notebook computer, the computer having a touch pad and a upper portion, the cover comprising an upper surface of nonconductive material, preferably neoprene, in contact with the upper portion of the computer when the computer is in a closed position, the upper surface also comprising a fabric layer of an anti-static material; a lower surface of nonconductive material opposite and parallel the upper surface, the lower surface in contact with the touch pad of the computer and depositing a powder residue of nonconductive material on the touch pad, thus enhancing its performance; and a storage compartment for storage of the touch pad cover when the computer is in use.

DETAILED DESCRIPTION

In accordance with this invention, it has been found that a novel touch pad cover may be provided for the protection of a Laptop/Notebook computer touch pad from environmental conditions, such as static electricity from the computer monitor and static discharges from the user, which cause touch pads to malfunction from time to time. Various other advantages and features will become apparent from the following description given with reference to the various figures and drawings.

Figure 1A:
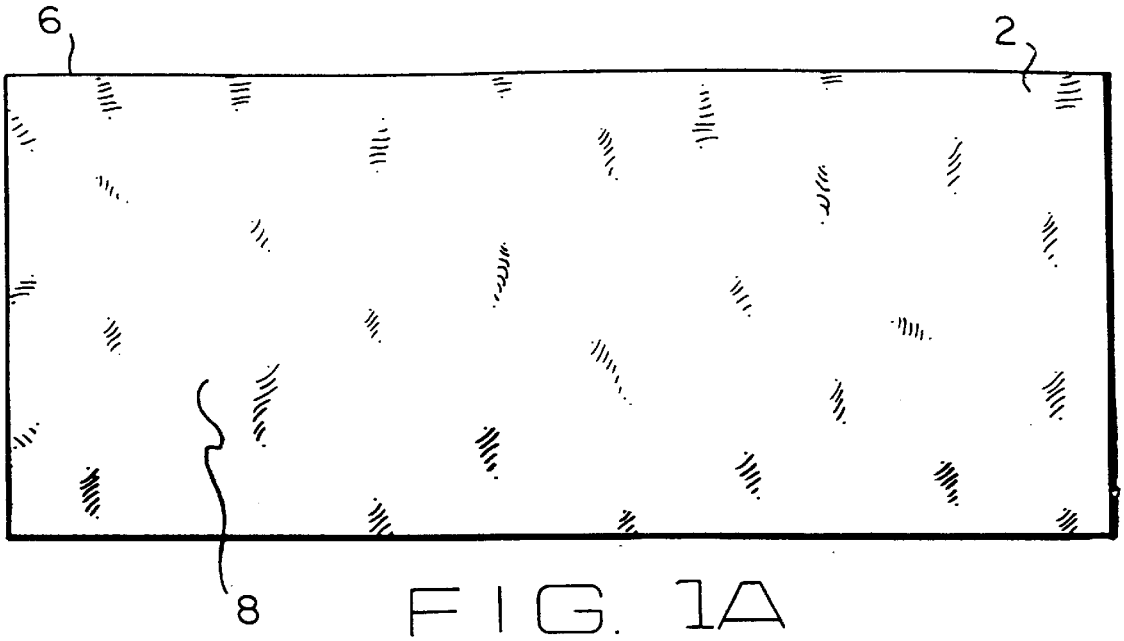
FIG. 1A is a top plan view of a touch pad cover.
Figure 1B:
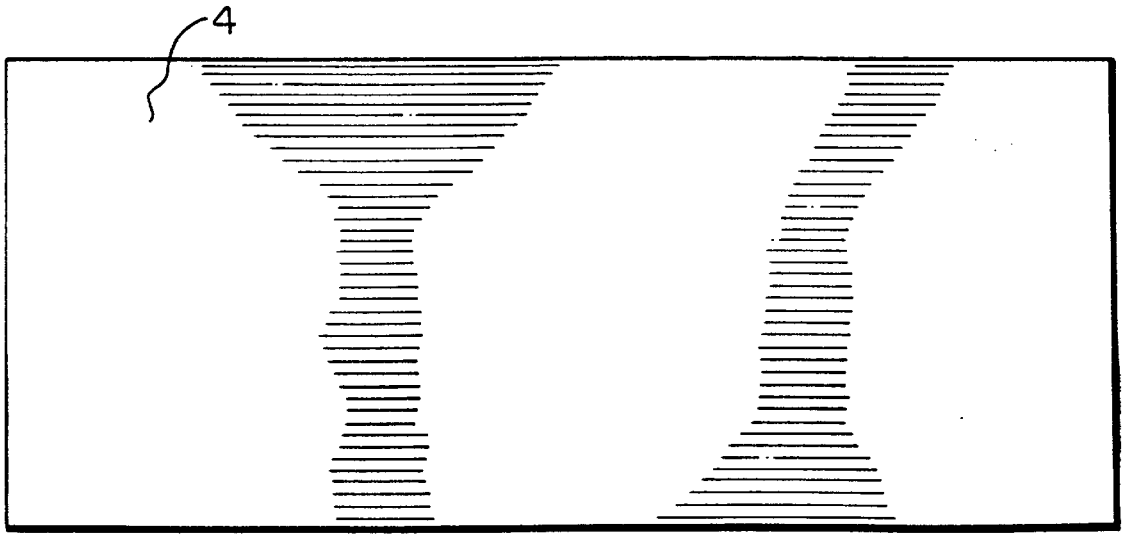
FIG. 1B is a bottom plan view of a touch pad cover.
Figure 1C:
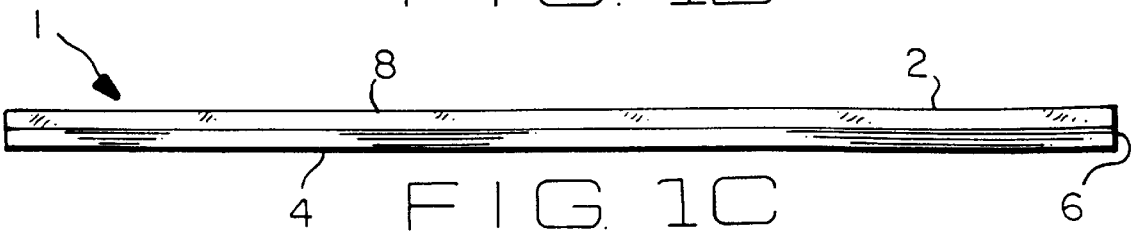
FIG. 1C is a side elevation view of a touch pad cover.

As seen in FIG. 1-A, a fabric layer 8 covers the upper surface 2 of neoprene touch pad cover 1. The fabric layer 8 is integral with the upper surface 2 and is attached by means such as by lamination. The fabric layer 8 is made of an anti-static fabric to aid in the shielding process.

In FIG. 1-C, a lower surface 4 of the touch pad cover 1 is provided parallel to and integral with the upper surface 2. An exterior wall 6 is formed between the upper surface 2 and the lower surface 4, connecting both surfaces. A suitable touch pad cover 1 can be provided from material used, for example, to supply mousepads. It is known in the industry to supply mouse pads with anti-static fabric backings in combination with a nonconductive pad. Such qualities have been found useful for the present invention.

The touch pad cover 1 may also be provided from materials having properties similar to neoprene. For instance, natural or synthetic rubbers or rubber combinations may be substituted for the neoprene component of the touch pad cover 1. At the broadest level, any nonconductive material used to separate the touch pad from the closed monitor screen should afford protection from static changes associated with the monitor and the user. However, it is believed that the use of a rubber-like material, particularly a friable material which generates and deposits a powder residue 13 on the touch pad 12, affords additional protection while the laptop is being used.

Upon the occurrence of erratic cursor movement, which is indicative of an environmental problem, it has been observed that rubbing the touch pad cover 1 against the touch pad 12 and/or rubbing the operator's fingers across the touch pad's rubber portion, the lower surface 4, will restore the normal functioning of the touch pad. Accordingly, it is believed that maintaining a light coating of powder residue 13 from the touch pad cover 1 in contact with the surface of touch pad 12, substantially improves the operation of the touch pad 12 under adverse environmental conditions.

Other methods of supplying and maintaining an effective amount of the protective powder residue 13 could include the use of a rubber surface associated with the keyboard and/or one or more keys. Repetitive touching of both the rubber surface and the touch pad can maintain the desired level of operability.

For instance, a margin of the touch pad 12 could have a rubber surface so that in normal operation of the touch pad 12, the users fingers can drag or engage the rubber surface. Alternatively, a frequently used key such as the space bar could have an exterior rubber coating. Again, repetitive use of the space bar and touch pad 12 maintains a continual supply of rubber powder residue 13.

Alternatively, a thin substantially permanent layer or dusting of powder residue 13 could be embedded onto the surface of the touch pad 12. Based upon the improvements noted by the continuous presence of a rubber powder residue 13, it is believed that a permanent thin layer of rubber as part of the touch pad 12 surface layer will offer similar improvements.

In the preferred embodiment of the invention, the touch pad cover 1 is appropriately sized to conform to the dimensions of the touch pad 12. As seen in FIG. 1B, the touch pad cover 1 is rectangular having four exterior walls (not shown) relative to exterior wall 6. However, the touch pad cover 1 shape may be adapted, for example, to represent any individual company logo.

Figure 2:
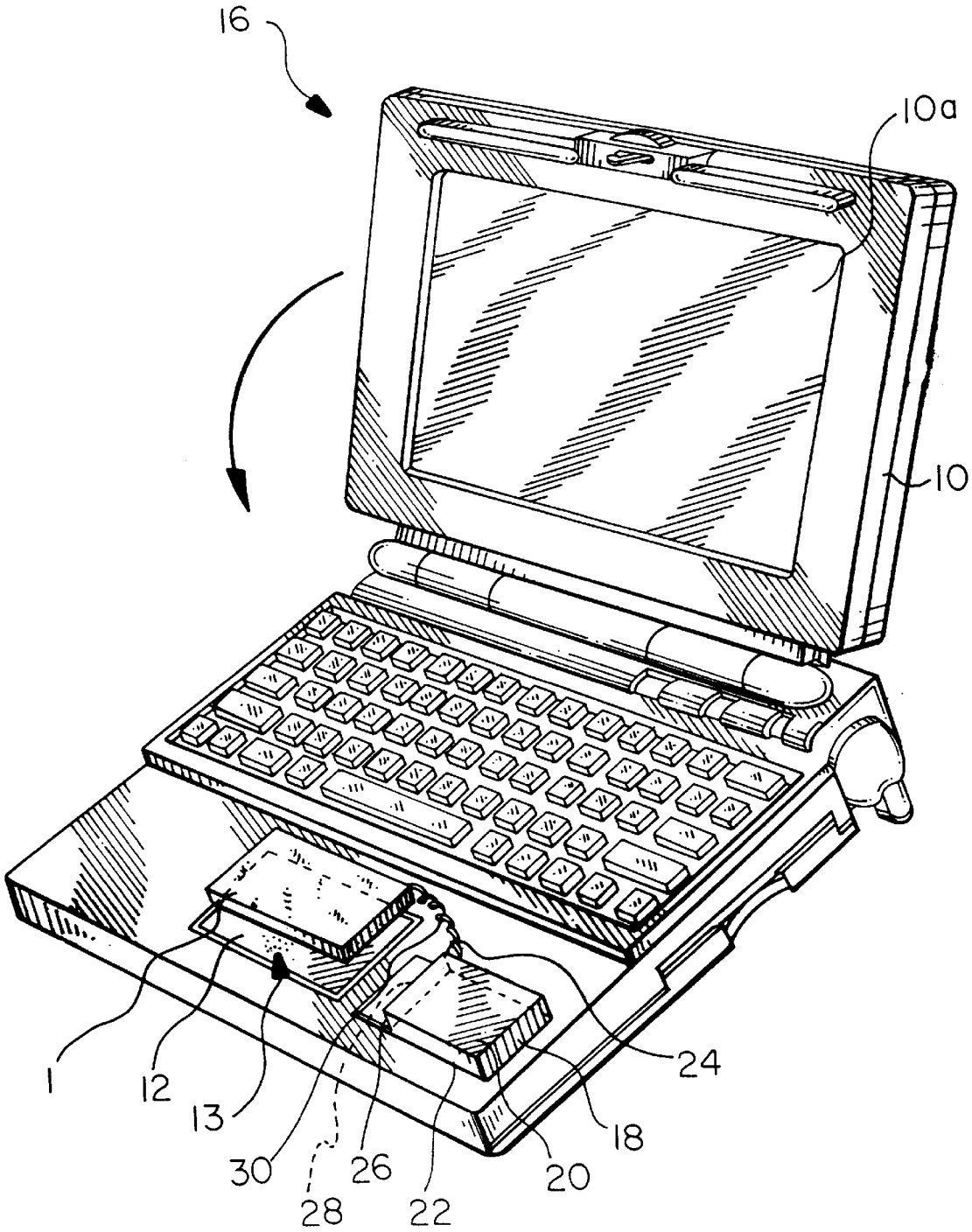
FIG. 2 is a perspective view of a touch pad cover as placed on a laptop computer.

Referring to FIG. 2, a Laptop/Notebook computer 16 is shown having an upper portion 10, a monitor 10*a*, and a touch pad 12. As the computer operates, a static charge is likely to build on the monitor 10*a* which is associated with the upper portion 10. When the computer is closed, the monitor 10*a* is in direct contact with the touch pad 12 possibly causing a transfer of static charge to the touch pad 12. This transfer of static charge may cause the touch pad 12 to malfunction at times. Therefore, a nonconductive touch pad cover 1 is provided to shield the touch pad 12 from the static charge of the monitor 10*a* as well as other environmental conditions.

When the computer 16 is closed, the upper portion 10 of the computer 16 is folded downwardly as shown by the directional arrow in FIG. 2. The touch pad cover 1 is placed over the touch pad 12 prior to closing the computer 16. In the preferred embodiment of the invention, the touch pad cover 1 extends fully co-planar with the exterior walls (not shown) of the touch pad. Once closed, the touch pad cover 1 is sandwiched between the upper portion 10 and the touch pad 12 protecting the touch pad.

In accordance with the invention, it has been found that the contact between the lower surface 4 of the touch pad cover 1 and the touch pad 12 results in a powder residue 13 of nonconductive material being left on the touch pad. The presence of this residue 13 on the touch pad 12 has been determined to enhance the performance of the touch pad 12 and reduce the incidence of touch pad malfunctioning under adverse environmental conditions.

In an alternate embodiment of the invention, the touch pad cover 1 may be slidably stored in an integrally connected storage compartment 18 when the computer 16 is in use (FIG. 2). The storage compartment 18 has a lower portion 22 which extends the length of the touch pad cover 1; and an upper portion 20 having notched portions 24 and 26 which form a recess 28 whereby the upper portion 20 does not extend to cover the touch pad cover 1 when it is in a stored position. This recess 28 is formed for easy removal and placement of the touch pad cover 1. A connector 30 is also provided between the touch pad cover 1 and the storage compartment 18.

The storage compartment 18 is approximately the dimensions of the touch pad cover 1 and may be made of either a flexible or rigid material such that the computer 16 may be closed without restriction. The storage compartment 18 may also be attached to the computer 16 by adhesive means if desired.

It is thus seen that a novel touch pad cover can be provided. This invention has been described with respect to a particular preferred embodiment thereof. Many variations will undoubtedly become apparent to one skilled in the art upon a reading of the above specification with reference to the drawings. Such variations, however, are within the spirit and scope of the invention as defined by the following appended claims.

That which is claimed:

1. A cover for protecting a touch pad of Laptop/Notebook computer, the computer having a touch pad and an upper portion, the cover comprising:

an upper surface of a nonconductive material in contact with an upper portion of said computer when the computer is in a closed position;

a lower surface of said nonconductive material opposite and parallel the upper surface, the lower surface in contact with the touch pad of the computer;

wherein the cover shields the touch pad from environmental influences from a computer and a user.

2. The cover according to claim 1, wherein the cover further comprises a friable material.

3. The cover according to claim 1, wherein the upper surface further comprises a fabric layer.

4. The cover according to claim 3, wherein said fabric layer is made of an anti-static fabric.

5. The cover according to claim 1, wherein the nonconductive material is neoprene.

6. The cover according to claim 1, wherein the nonconductive material leaves a powder residue on the touch pad.

7. The cover according to claim 1, wherein the cover extends fully co-planar with an exterior wall of the touch pad.

8. A method for reducing environmental interference with a touch pad of a Laptop/Notebook computer, the computer having a touch pad and an upper portion, the method comprising determining the touch pad shape and dimensions;

providing a cover having dimensions sufficient to cover the touch pad shape and dimensions, the cover comprising:

an upper surface of nonconductive material in contact with the upper portion of the computer when the computer is in a closed position; and a lower surface of said nonconductive material opposite and parallel the upper surface, the lower surface in contact with the touch pad of the computer;

placing the lower surface in contact with the touch pad; and closing the computer such that the lower surface remains in contact with the touch pad and the upper surface is in contact with the upper portion.

9. The method according to claim 8, wherein the method comprises an additional step of depositing a powder residue material onto the touch pad.

10. The method according to claim 8, wherein the nonconductive material is neoprene.

11. The method according to claim 8, wherein the upper surface further comprises a fabric layer.

12. The method according to claim 11, wherein said fabric layer is made of an anti-static fabric.

13. The method according to claim 8, wherein the step of placing the cover over the touch pad further comprises:

removing said touch pad cover from a storage compartment defined by the computer.

14. The method according to claim 13, wherein said storage compartment further comprises:

a lower portion resting on or attached to the computer;

an upper portion parallel to the lower portion;

notched portions extending from the upper portion to the lower portion; and a recess formed by the notched portions on the upper portion.

15. The method according to claim 13, wherein the touch pad cover is slidably stored in said storage compartment.

16. The method according to claim 15, wherein said touch pad is stored in said storage compartment when said computer is in an open position.

17. The method according to claim 13, wherein the storage compartment is adhesively attached to the computer.

18. The method according to claim 13, wherein the touch pad cover is integrally connected to the storage compartment.

* * * * *